US007630667B2

(12) United States Patent
Huang et al.

(10) Patent No.: US 7,630,667 B2
(45) Date of Patent: Dec. 8, 2009

(54) SUPPORTING APPARATUS FOR A PHOTOSENSITIVE DRUM

(75) Inventors: Shih-Hsiung Huang, Taichung County (TW); Shin-Yi Chen, Taichung County (TW)

(73) Assignee: General Plastic Industrial Co., Ltd., Taichung County (TW)

( * ) Notice: Subject to any disclaimer, the term of this patent is extended or adjusted under 35 U.S.C. 154(b) by 212 days.

(21) Appl. No.: 11/745,301

(22) Filed: May 7, 2007

(65) Prior Publication Data

US 2008/0279584 A1 Nov. 13, 2008

(51) Int. Cl.
*G03G 15/00* (2006.01)
*G03G 15/02* (2006.01)

(52) U.S. Cl. ..... 399/117; 399/116; 399/110; 399/107

(58) Field of Classification Search ..... 399/117, 399/116, 107, 110
See application file for complete search history.

(56) References Cited

U.S. PATENT DOCUMENTS 5,825,472 A * 10/1998 Araki et al. ..... 399/111
6,198,891 B1 * 3/2001 Ishida et al. ..... 399/117
6,381,429 B1 * 4/2002 Shibata et al. ..... 399/117
7,050,736 B2 * 5/2006 Hale et al. ..... 399/90
2003/0002886 A1 * 1/2003 Kobayashi et al. ..... 399/167
2003/0099485 A1 * 5/2003 Ahn et al. ..... 399/117
2006/0045568 A1 * 3/2006 Kishi et al. ..... 399/111
2007/0237545 A1 * 10/2007 Cho et al. ..... 399/117

* cited by examiner

*Primary Examiner*—David M Gray
*Assistant Examiner*—Rodney Bonnette
(74) *Attorney, Agent, or Firm*—Browdy and Neimark, P.L.L.C.

(57) ABSTRACT

For supporting a cylindrical photosensitive drum, a high-precision high-strength supporting apparatus is disclosed to include a sleeve member and a shaft member. The sleeve member has an outer wall for attaching to the photosensitive drum, an inner wall within which an axial hole is defined, a first retaining portion positioned at the inner wall, and four locating ribs disposed inside the axial hole. The shaft member has an outer tube inserted into the axial hole of the sleeve member, a second retaining portion provided on the outer tube and engaged with the first retaining portion of the sleeve member, a connecting portion inwardly extending from the outer tube, an inner tube disposed at an inner end of the connecting portion, and four locating slot provided on the inner tube and engaged with the locating rib of the sleeve member.

10 Claims, 9 Drawing Sheets

SUPPORTING APPARATUS FOR A PHOTOSENSITIVE DRUM

BACKGROUND OF THE INVENTION

1. Field of the Invention

The present invention relates to electronic image forming apparatus and more particularly, to a supporting apparatus for a photosensitive drum, which has a high precision and high strength structure for supporting a photosensitive drum on a toner cartridge.

2. Description of the Related Art

A regular electronic image forming apparatus such as copier or printer generally has a cylindrical photosensitive drum mounted in a toner cartridge. During installation, two shaft members are fastened to the two opposite ends of the photosensitive drum, and then the photosensitive drum is mounted in the housing of the toner cartridge as designed and supported between two end caps in the housing of the toner cartridge. The end caps each have a coupling tube for receiving the shaft members respectively, allowing rotation of the photosensitive drum around the shaft members.

The aforesaid two end caps are bonded to the housing of the toner cartridge by ultrasonic welding, not detachable. When replacing the photosensitive drum, at least one shaft member must be broken. When installing a new photosensitive drum, as shown in FIG. 1, a sleeve member 2 which has an axial hole 3 and four longitudinal locating grooves 4 equiangularly spaced around the axial hole 3 is fastened to one end of the photosensitive drum 1, and then the photosensitive drum 1 with the sleeve member 2 are inserted into the housing of the toner cartridge (not shown), and then an shaft member 5 is inserted into the axial hole 3 to support the photosensitive drum on a coupling tube at one end cap in the housing of the toner cartridge. The shaft member 5 has four longitudinal locating ribs 7 respectively engaged with the four longitudinal locating grooves 4 of the sleeve member 2 and four hooks 6 hooked on one end edge of the sleeve member 2. Therefore, the sleeve member 2 is firmly connected with the shaft member 5 for synchronous rotation with the shaft member 5.

The aforesaid sleeve member 2 and shaft member 5 are respectively molded from plastics. Because the shaft member 5 has four longitudinal ribs 7 and the sleeve member 2 has four longitudinal grooves 4, the sleeve member 2 and shaft member 5 may not have a superior concentricity due to existing mold stripping technical problem, resulting in eccentric rotation of the photosensitive drum. Further, because the sleeve member 2 is shaped like a round tube, it has a low structural strength and tends to be deformed. Deformation of the sleeve member 2 will also affect the rotation action of the photosensitive drum.

SUMMARY OF THE INVENTION

The present invention has been accomplished under the circumstances in view. It is one object of the present invention to provide a supporting apparatus for a photosensitive drum, which has a high structural precision.

It is another object of the present invention to provide a supporting apparatus for a photosensitive drum, which has a high structural strength.

To achieve these and other objects of the present invention, the supporting apparatus for photosensitive drum comprises a sleeve member and a shaft member. The sleeve member is provided with an outer wall for attaching to an inner periphery of the photosensitive drum, an inner wall within which an axial hole is defined, a first retaining portion positioned at the inner wall, and at least one locating rib disposed inside the axial hole. The shaft member has an outer tube inserted into the axial hole of the sleeve member, a second retaining portion provided on the outer tube and engaged with the first retaining portion of the sleeve member, a connecting portion inwardly extending from the outer tube, an inner tube disposed at an inner end of the connecting portion, and at least one locating slot provided on the inner tube and engaged with the locating rib of said sleeve member.

DETAILED DESCRIPTION OF THE INVENTION

Figure 1:
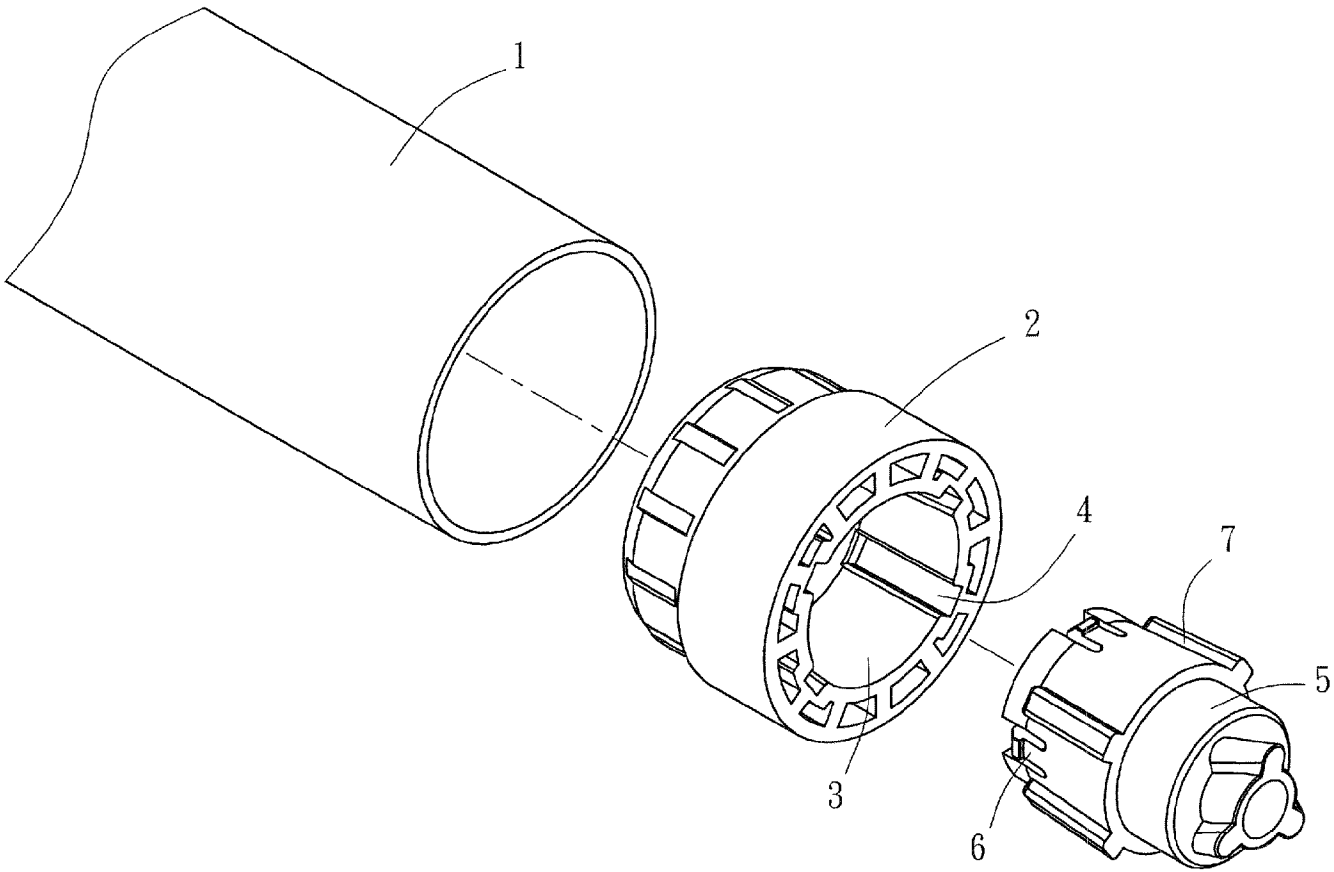
FIG. 1 PRIOR ART
FIG. 1 is an exploded view of a supporting apparatus for photosensitive drum according to the prior art.
Figure 2:
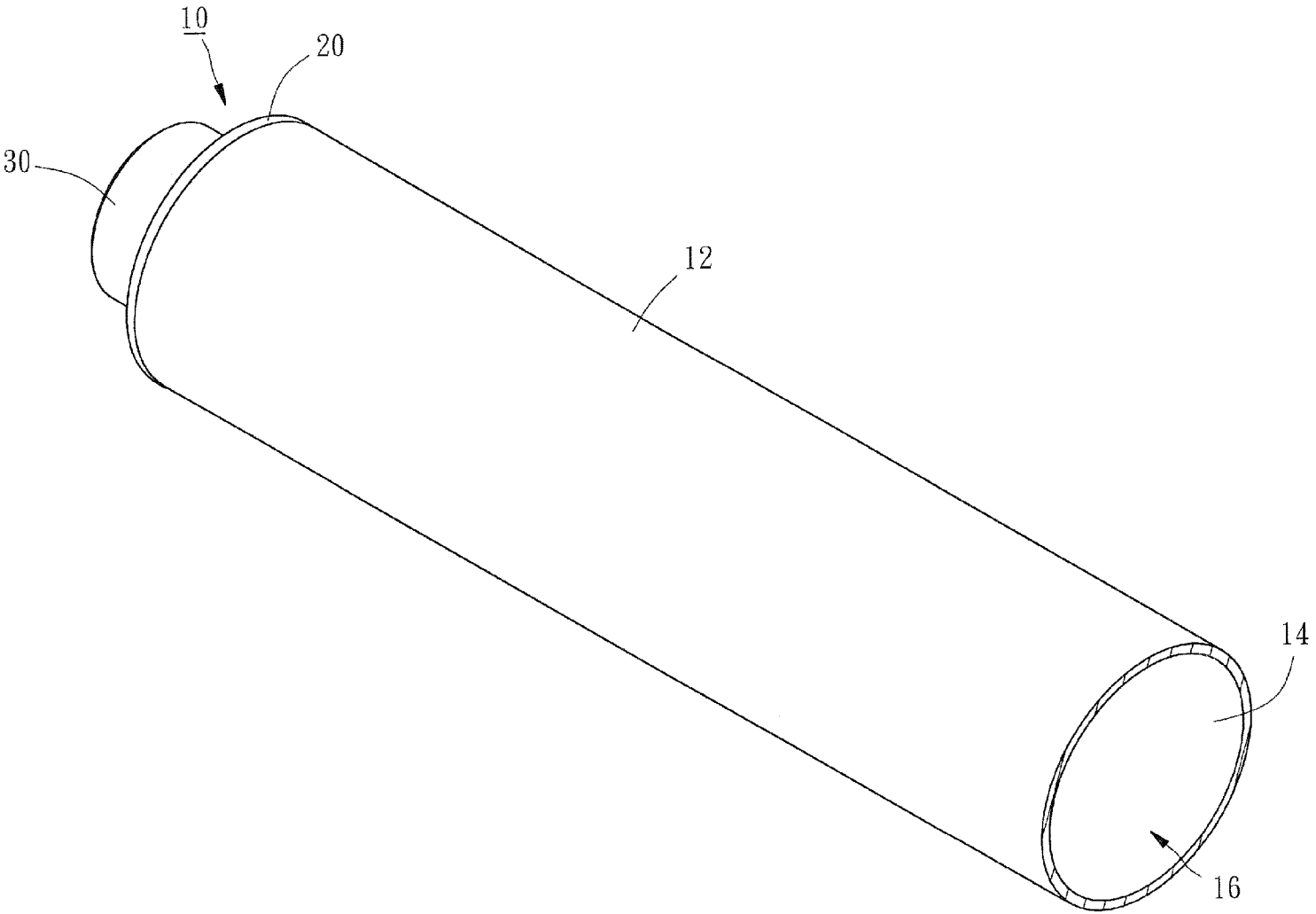
FIG. 2 is a perspective view of a first embodiment of the present invention.

Referring to FIG. 2, a supporting apparatus 10 in accordance with the first embodiment of the present invention is shown fastened to a photosensitive drum 12. The photosensitive drum 12 is a cylindrical drum. The supporting apparatus 10 is comprised of a sleeve member 20 and a shaft member 30.

Figure 3:
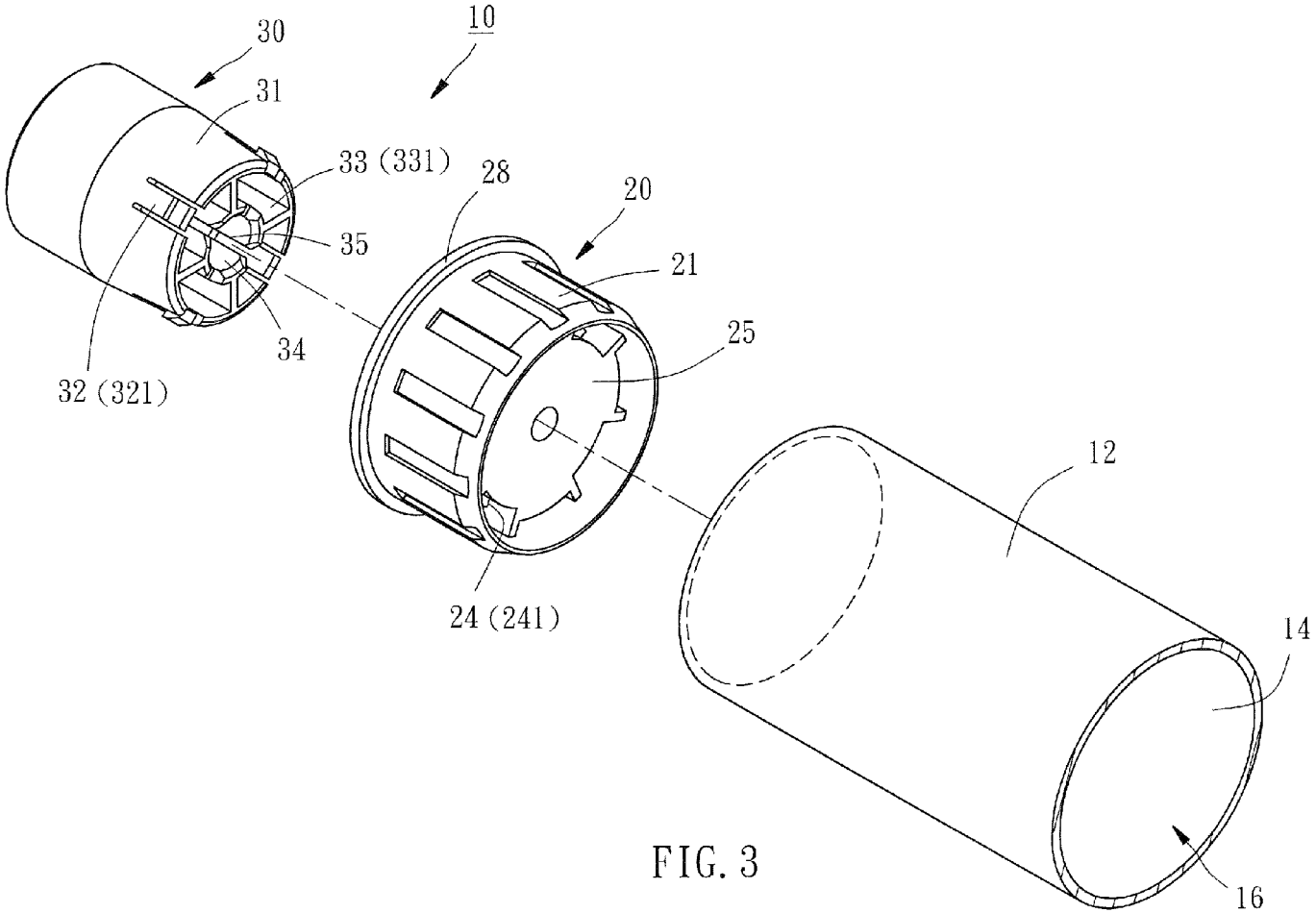
FIG. 3 is an exploded view of the first embodiment of the present invention.
Figure 4:
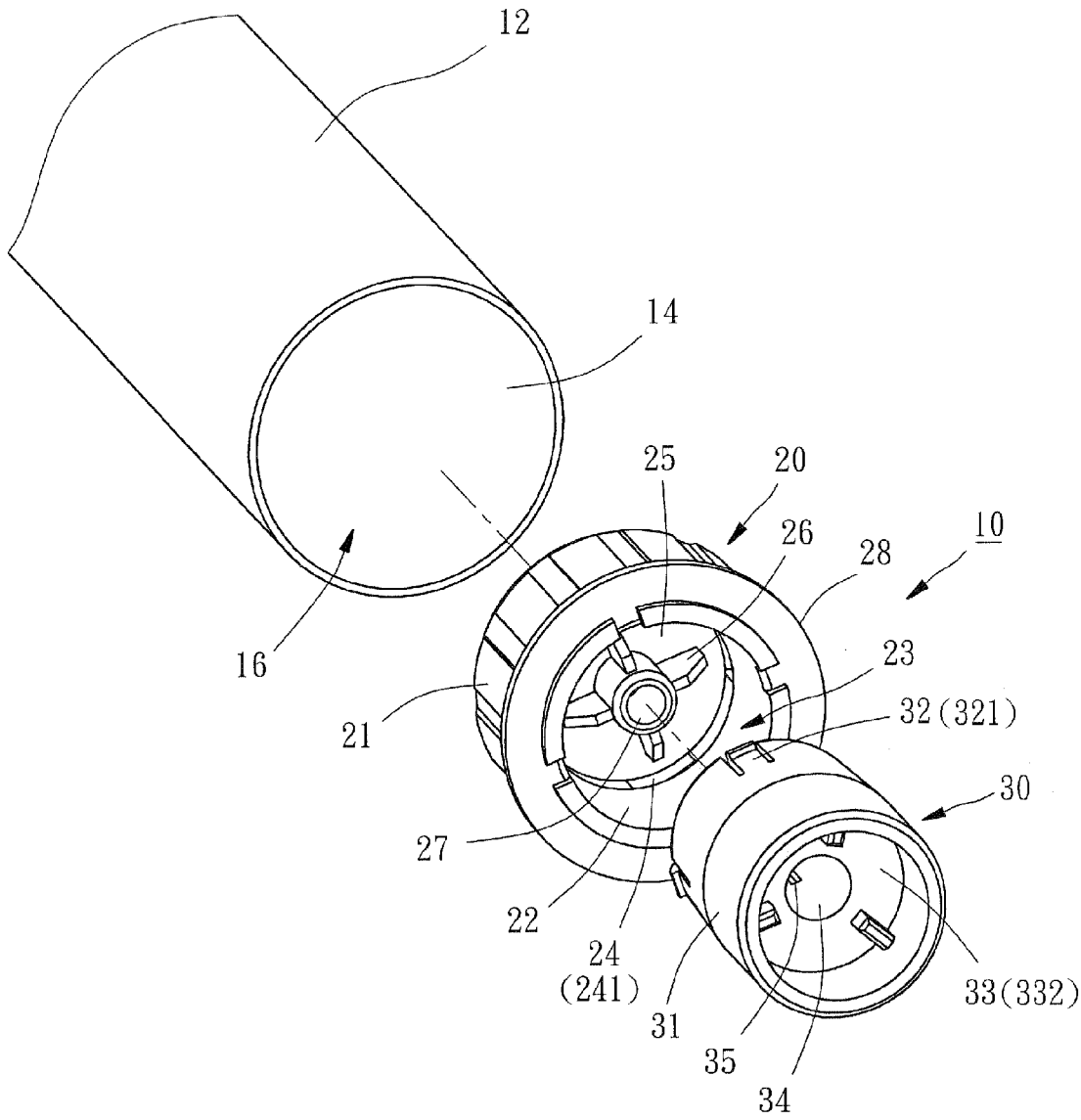
FIG. 4 corresponds to FIG. 3 when viewed from another angle.

Referring to FIGS. 3 and 4, the sleeve member 20 has an outer wall 21 closely attached to the inner periphery 14 of the photosensitive drum 12, an inner wall 22 within which an axial hole 23 is defined, a first retaining portion 24 positioned at the inner wall 22, a bottom plate 25 radially extending from the inner wall 22, four locating ribs 26 axially extending from the bottom plate 25, a center tube 27 axially extending from the center of the bottom plate 25 and connected to the inner ends of the locating ribs, and a protruding rim 28 extending from the outer wall 21 for stopping at one end of the photosensitive drum 12. According to this first embodiment, the first retaining portion 24 is comprised of four retaining holes 241.

The shaft member 30 has an outer tube 31 inserted into the axial hole 23 of the sleeve member 20, a second retaining portion 32 provided on said outer tube 31 and engaged with the first retaining portion 24 of the sleeve member 20, a connecting portion 33 inwardly extending from said outer tube 31, an inner tube 34 disposed at an inner end of said connecting portion 33 for receiving the center tube 27 of the sleeve member 20, and four locating slots 35 provided on said inner tube 34 and engaged with the locating rib 26 of said sleeve member 20. According to this first embodiment, the second retaining portion 32 of the shaft member 30 comprises four hooks 321 respectively engaged with the retaining holes 241 of the sleeve member 20. Further, the connecting portion 33 comprises an annular plate 332 radially extending between the inner tube 34 and the outer tube 31, and a four ribs 331 perpendicularly extending from the annular plate 332 and connected between the inner tube 34 and the outer tube 31. Thus, the sleeve member 20 and the shaft member 30 are fastened together for synchronous rotation.

During installation of the photosensitive drum 12 in a toner cartridge (not shown), insert the sleeve member 20 into an axial hole 16 of the photosensitive drum 12 such that the protruding rim 28 of the sleeve member 20 is stopped at one end of the photosensitive drum 12, and then place the photosensitive drum 12 with the sleeve member 20 into the toner cartridge, and then insert the shaft member 30 into the axial hole 23 of the sleeve member 20, and thus the installation of the photosensitive drum 12 is done.

Because the sleeve member 20 of the supporting apparatus 10 has a bottom plate 25, the structural strength of the sleeve member 20 in radial direction is reinforced. Further, the connecting portion 33 and the inner tube 34 also reinforce the structural strength of the shaft member 30. Therefore, the supporting apparatus 10 has a high structural strength. Further, because the shaft member 30 does not have the conventional design of longitudinal ribs and the sleeve member 20 does not have the conventional design of longitudinal locating grooves, the invention eliminates the concentricity problem of the prior art design due to existing mold stripping technical problem. Therefore, the supporting apparatus 10 of the present invention meets the requirement for high precision, and eliminates the problem of eccentric rotation of the photosensitive drum 12.

Figure 5:
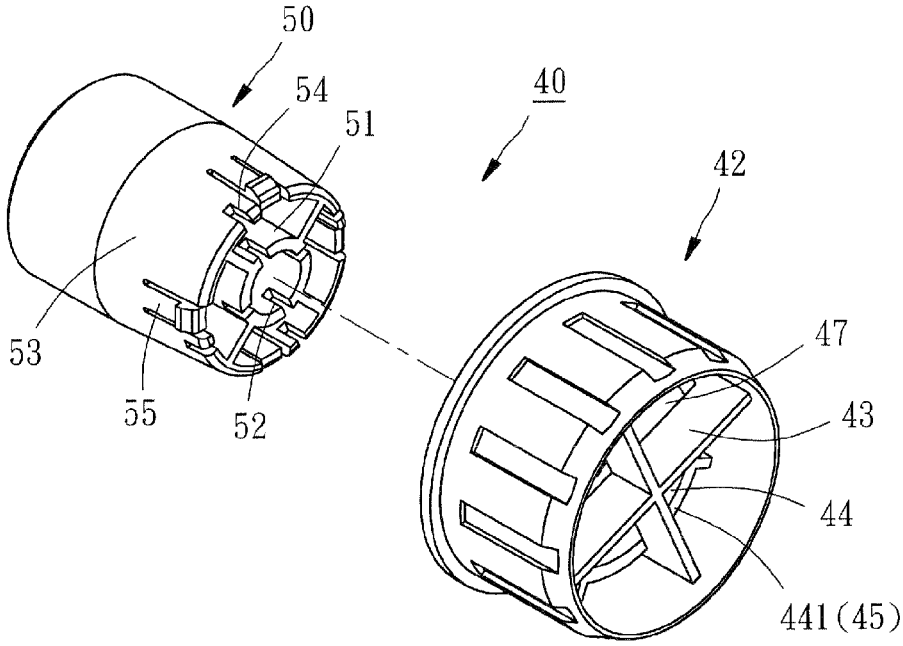
FIG. 5 is an exploded view of a second embodiment of the present invention.
Figure 6:
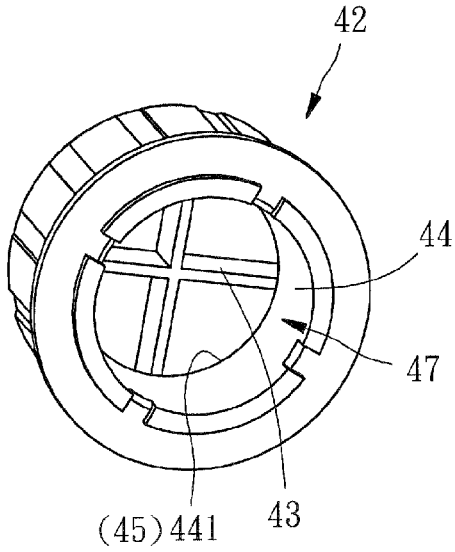
FIG. 6 is a perspective view of the sleeve member according to the second embodiment of the present invention.

Based on the spirit of the invention, the supporting apparatus may be variously embodied. FIGS. 5 and 6 show a supporting apparatus 40 in accordance with the second embodiment of the present invention. According to this second embodiment, the supporting apparatus 40 is comprised of a sleeve member 42 and a shaft member 50. The sleeve member 42 of this second embodiment is substantially similar to the sleeve member of the aforesaid first embodiment with the exception that the sleeve member 42 has its locating ribs 43 directly extending from the inner wall 44 and the sleeve member 42 eliminates the bottom plate 25 and the center tube 27 of the aforesaid first embodiment. In addition to the four locating slots 52 on the inner tube 51, the shaft member 50 further has four locating slots 54 on the outer tube 53 for receiving the locating ribs 43 of the sleeve member 42. Thus, the sleeve member 42 and the shaft member 50 can be joined together more firmly. Further, the first retaining portion 45 of the sleeve member 42 is disposed at one end 441 of the inner wall 44. When the shaft member 50 is inserted into the axial hole 47 of the sleeve member 42, the four hooks 55 of the shaft member 50 are hooked on the end 441 of the inner wall 44 of the sleeve member 42 such that the sleeve member 42 and the shaft member 50 can be connected together. According to this second embodiment, the structure of the sleeve member 42 is simple.

Figure 7:
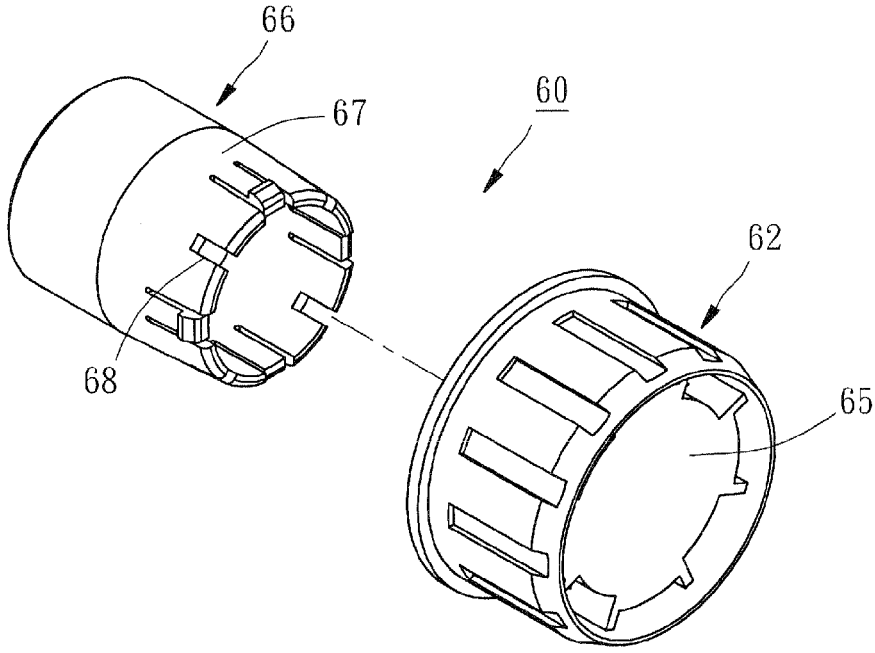
FIG. 7 is an exploded view of a third embodiment of the present invention.
Figure 8:
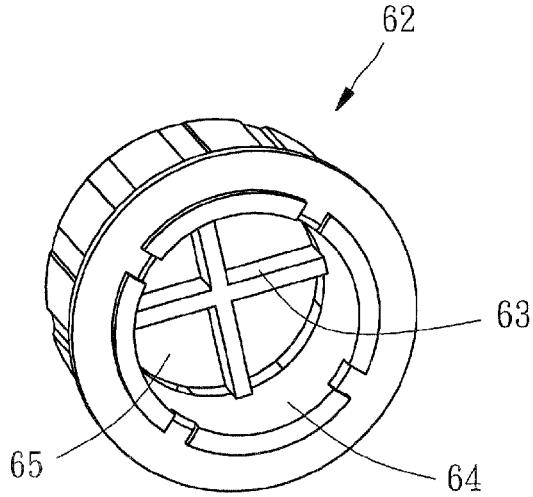
FIG. 8 is a perspective view of the sleeve member according to the third embodiment of the present invention.

FIGS. 7 and 8 show a supporting apparatus 60 in accordance with the third embodiment of the present invention. According to this third embodiment, the supporting apparatus 60 is substantially similar to the aforesaid first embodiment with the exception that the sleeve member 62 has four locating ribs 63 extending from the inner wall 64, and a bottom plate 65 extending from the inner wall 64 and connected to the locating ribs 63. The shaft member 66 of the supporting apparatus 60 eliminates the aforesaid connecting portion 33 and inner tube 34 in the first embodiment. The outer tube 67 of the shaft member 66 has four locating slots 68 for receiving the four locating ribs 63 of the sleeve member 62. Therefore, the sleeve member 62 of this third embodiment has a structural strength superior to the sleeve member 20 of the aforesaid first embodiment.

Figure 9:
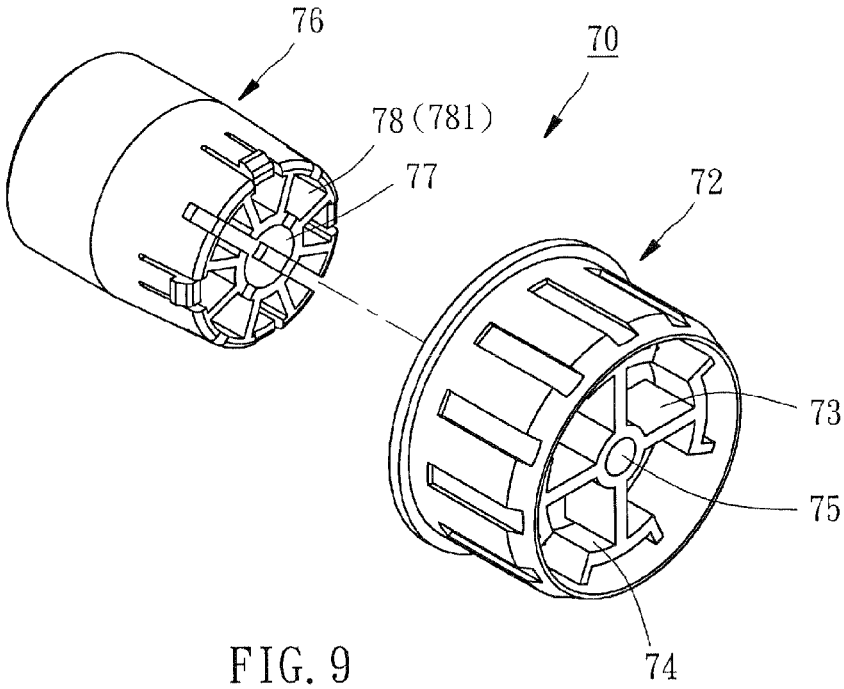
FIG. 9 is an exploded view of a fourth embodiment of the present invention.
Figure 10:
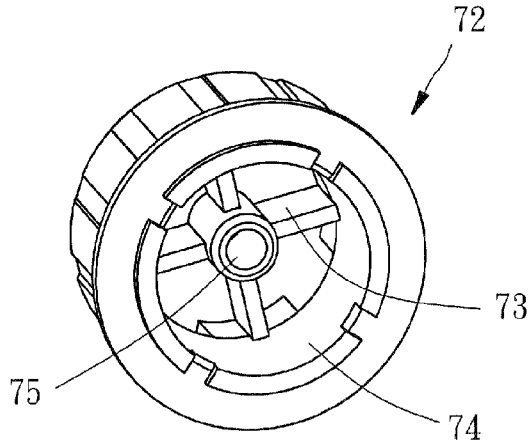
FIG. 10 is a perspective view of the sleeve member according to the fourth embodiment of the present invention.
Figure 11:
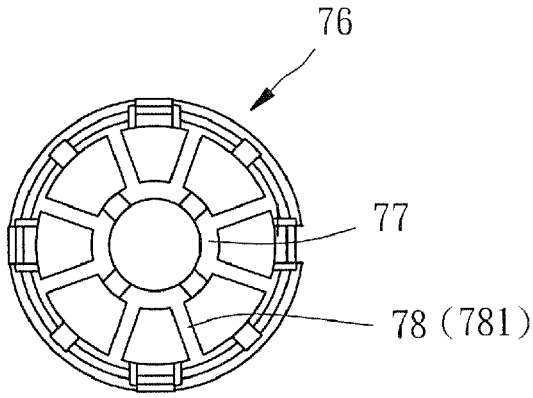
FIG. 11 is a side view of the shaft member according to the fourth embodiment of the present invention.

FIGS. 9~11 show a supporting apparatus 70 in accordance with the fourth embodiment of the present invention. According to this fourth embodiment, the supporting apparatus 70 is substantially similar to the aforesaid second embodiment with the exception that the sleeve member 72 of the supporting apparatus 70 has four locating ribs 73 extending from its inner wall 74 and a center tube 75 suspending in the axial hole and connected with the locating ribs 73. The center tube 75 is inserted into the inner tube 77 of the shaft member 76 to reinforce the structural stability of the sleeve member 72 and the shaft member 76. As shown in FIG. 11, the connecting portion 78 of the shaft member 76 has only several ribs 781 but eliminates the annular plate 332 of the first embodiment.

Figure 12:
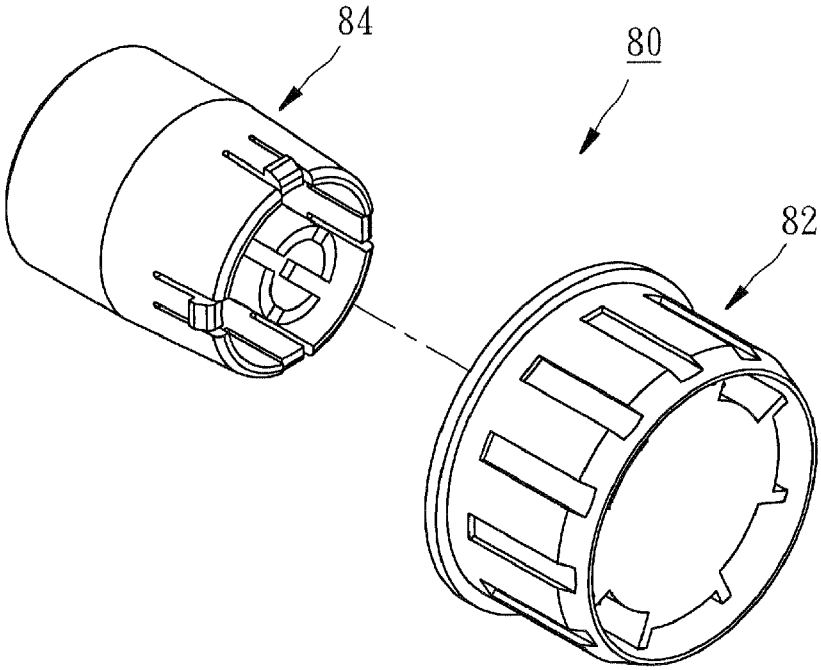
FIG. 12 is an exploded view of a fifth embodiment of the present invention.
Figure 13:
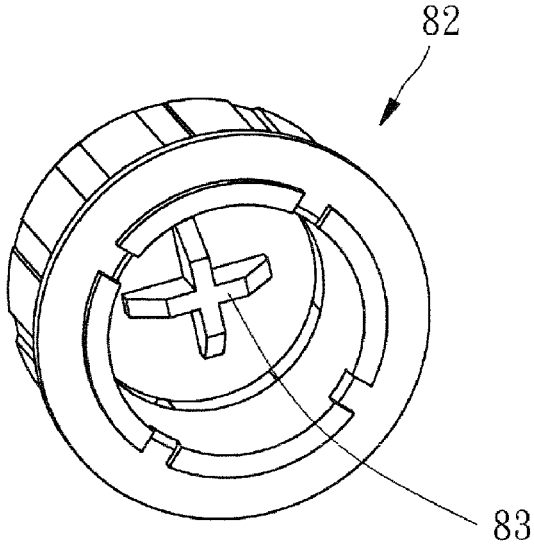
FIG. 13 is a perspective view of the sleeve member according to the fifth embodiment of the present invention.
Figure 14:
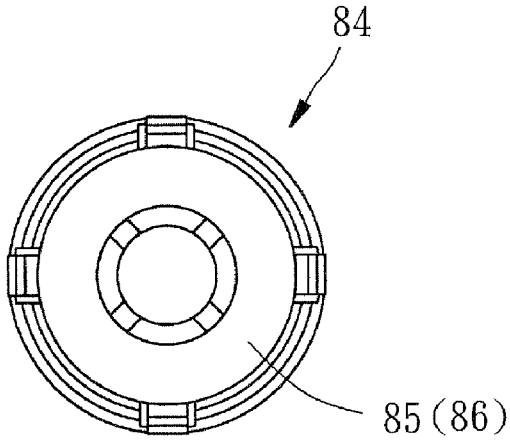
FIG. 14 is a side view of the shaft member according to the fifth embodiment of the present invention.

FIGS. 12~14 show a supporting apparatus 80 in accordance with the fifth embodiment of the present invention. According to this fifth embodiment, the supporting apparatus 80 is substantially similar to the aforesaid first embodiment with the exception that the sleeve member 82 of the supporting apparatus 80 eliminates the center tube 27 of the aforesaid first embodiment, and has the four locating ribs 83 arranged in a crossed manner. The connecting portion 85 of the shaft member 84 has only the annular plate 86 but eliminates the ribs 331 of the aforesaid first embodiment.

In actual practice, the locating ribs of the sleeve member can be designed to extend from the bottom plate or the inner wall within the axial hole, Further, the first retaining portion of the sleeve member and the second retaining portion of the shaft member may be variously embodied. The number of the locating ribs and locating slots and the number of the ribs may be changed.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A supporting apparatus for a cylindrical photosensitive drum, the supporting apparatus comprising:

a sleeve member provided with an outer wall for attaching to an inner periphery of said photosensitive drum, an inner wall within which an axial hole is defined, a first retaining portion positioned at said inner wall, and at least one locating rib disposed inside said axial hole; and a shaft member having an outer tube inserted into said axial hole of said sleeve member, a second retaining portion provided on said outer tube and engaged with the first retaining portion of said sleeve member, a connecting portion inwardly extending from said outer tube, an inner tube disposed at an inner end of said connecting portion, and at least one locating slot provided on said inner tube and engaged with the locating rib of said sleeve member;

wherein said connecting portion of said shaft member has at least one rib connecting between the outer tube and the inner tube.

2. The supporting apparatus as claimed in claim 1, wherein said locating rib extends from the inner wall of said sleeve member.

3. The supporting apparatus as claimed in claim 2, wherein said sleeve member further comprises a bottom plate extending from said inner wall and connected to said locating rib.

4. The supporting apparatus as claimed in claim 1, wherein said sleeve member further comprises a bottom plate extending from said inner wall, and said locating rib extends from said bottom plate.

5. The supporting apparatus as claimed in claim 1, wherein said sleeve member further comprises a center tube suspending in said axial hole and connected to said locating rib such that said center tube is inserted into the inner tube of said shaft member.

6. The supporting apparatus as claimed in claim 1, wherein said connecting portion of said shaft member has an annular plate connecting between the outer tube and the inner tube.

7. The supporting apparatus as claimed in claim 1, wherein said sleeve member has a protruding rim extending from said outer wall for stopping at one end of said photosensitive drum.

8. The supporting apparatus as claimed in claim 1, wherein the first retaining portion of said sleeve member has at least one retaining hole.

9. The supporting apparatus as claimed in claim 1, wherein the first retaining portion of said sleeve member is disposed at one end of said inner wall.

10. The supporting apparatus as claimed in claim 1, wherein the second retaining portion of said shaft member has at least one hook.

* * * * *